US006002305A

United States Patent [19]

Sanford et al.

[11] Patent Number: 6,002,305

[45] Date of Patent: Dec. 14, 1999

[54] TRANSITION BETWEEN CIRCUIT TRANSMISSION LINE AND MICROWAVE WAVEGUIDE

[75] Inventors: John R. Sanford, Palo Alto; James A. Wilfong, San Carlos, both of Calif.

[73] Assignee: Endgate Corporation, Sunnyvale, Calif.

[21] Appl. No.: 08/937,754

[22] Filed: Sep. 25, 1997

[51] Int. Cl.[6] ..... H01P 5/107

[52] U.S. Cl. ..... 333/26; 333/34

[58] Field of Search ..... 333/21 R, 26, 333/33, 34

[56] References Cited

U.S. PATENT DOCUMENTS

| | | | |
|---|---|---|---|
| 2,825,876 | 3/1958 | Vine et al. . | |
| 2,829,348 | 4/1958 | Kostriza et al. | 333/26 |
| 3,579,149 | 5/1971 | Ramsey . | |
| 3,969,691 | 7/1976 | Saul . | |
| 4,052,683 | 10/1977 | van Heuven et al. | 333/26 X |
| 4,453,142 | 6/1984 | Murphy | 333/26 |
| 4,458,222 | 7/1984 | Herstein et al. . | |
| 4,716,386 | 12/1987 | Lait . | |
| 4,716,387 | 12/1987 | Igarashi . | |
| 4,739,519 | 4/1988 | Findley | 333/26 X |
| 4,742,571 | 5/1988 | Letron . | |
| 4,754,239 | 6/1988 | Sedivec . | |
| 4,901,040 | 2/1990 | Ahlborn et al. . | |
| 4,973,925 | 11/1990 | Nusair et al. . | |
| 5,043,683 | 8/1991 | Howard . | |
| 5,095,292 | 3/1992 | Masterton . | |
| 5,202,648 | 4/1993 | McCandless | 333/26 |
| 5,225,797 | 7/1993 | Schary et al. . | |
| 5,262,739 | 11/1993 | Dalman . | |

*Primary Examiner*—Paul Gensler
*Attorney, Agent, or Firm*—Anderson & Adamson, LLP

[57] ABSTRACT

A transition is provided for interfacing a coplanar waveguide with a three dimensional microwave waveguide. The transition includes three coplanar conductors that are formed integrally with and extend from the coplanar waveguide. The transition extends into the microwave waveguide through a slot, with the plane of the transition being perpendicular to the direction of propagation of the electric field in the waveguide. The center conductor of the transition is a patch whose width increases. The other two conductors are attached to the side conductors of the coplanar waveguide and to the exterior of the waveguide. They flank the patch and have curved edges complementary to those of the patch. The gaps are initially narrow, and become wider gradually. Further, as each guide steers the electric field while changing direction by 90°, it rotates the orientation of the electric field vector by the same amount.

7 Claims, 2 Drawing Sheets

TRANSITION BETWEEN CIRCUIT TRANSMISSION LINE AND MICROWAVE WAVEGUIDE

BACKGROUND OF THE INVENTION

1. Field of the Invention

The present invention relates to transitions between a conductor-based transmission line and a three dimensional microwave waveguide.

2. Description of Related Art

In microwave circuit design it is often necessary to interface circuit boards with other circuit components. Circuit boards typically communicate via one of various conductor-based transmission lines, such as microstrip, stripline, coplanar waveguide or slotline. Three-dimensional microwave waveguides typically have rectangular or circular cross sections, and are hollow with metallic shells or are made of waveguide-conducting dielectric. These three dimensional waveguides are referred to herein as microwave waveguides or simply waveguides.

Adaptors or transitions, also referred to as launches, are employed to interface the two different types of media with each other. Such transitions typically suffer from losses due to attenuation and impedance mismatches (reflections). Conventional transitions to microwave waveguide are from stripline or microstrip. The transition is usually via an end of a microwave waveguide section, although it is known to introduce a stripline element laterally through a side of a microwave waveguide, as is illustrated in U.S. Pat. No. 4,716,386 issued to Lait. U.S. Pat. No. 4,901,040 issued to Ahlborn et al. discloses a transition from microwave in which a T-shaped element is positioned in the microwave waveguide.

At very high frequencies, such as above 20GHz, active printed circuits are preferably in the form of coplanar waveguides having a signal conductor bounded by two signal return or ground conductors. Device interconnects are preferably provided by microwave waveguides. The printed circuits allow low cost production while microwave waveguides allow easy interconnections and a low loss transmission line for filters and other components.

There is therefore a need for transitions between conductor-based circuits and microwave waveguides which have a wide transmission bandwidth and have low loss due to the generation of spurious modes. At higher frequencies in which coplanar waveguides are used for printed circuits, it is desirable to have such a transition directly between coplanar waveguide and microwave waveguide.

SUMMARY OF THE INVENTION

The invention provides a transition for interfacing a circuit board transmission line with a hollow three dimensional microwave waveguide that has wide bandwidth and low loss.

Generally, the invention provides a pair of conducting edges defining a gap extending through an opening into the interior of the waveguide. The gap is oriented within the interior of the waveguide in a plane that is transverse to the orientation of the waveguide.

In the preferred form of the invention a patch is directly attached to a center conductor of coplanar waveguide and extends into the microwave waveguide through a slot. Two complementary transition conductors are attached to corresponding ground conductors. These transition conductors flank the patch and have curved edges complementary to those of the patch. This way two smooth curved edges are formed that guide the electric field. The edges are preferably continuous and smooth. Further, each guide steers the electric field while changing direction by 90°. The orientation of the electric field vector is thereby rotated by the same amount to provide optimum vector alignment in the waveguide.

In the preferred embodiment the patch and the transition conductors are coplanar and are formed integrally with the coplanar waveguide. The transition is disposed in a plane perpendicular to the direction of propagation of the electric field in the waveguide. If the waveguide is of the hollow type made by a main exterior conductor, the complementary transition conductors are also attached to the waveguide shell.

It is additionally preferred that a portion of the complementary conductors extends into the three dimensional waveguide. This permits a longer transition between the coplanar waveguide and the waveguide, further minimizing impedance losses.

These and other features of the invention will be apparent from the preferred embodiment described in the following detailed description and illustrated in the accompanying drawings.

DETAILED DESCRIPTION OF THE PREFERRED EMBODIMENT(S)

Figure 1:
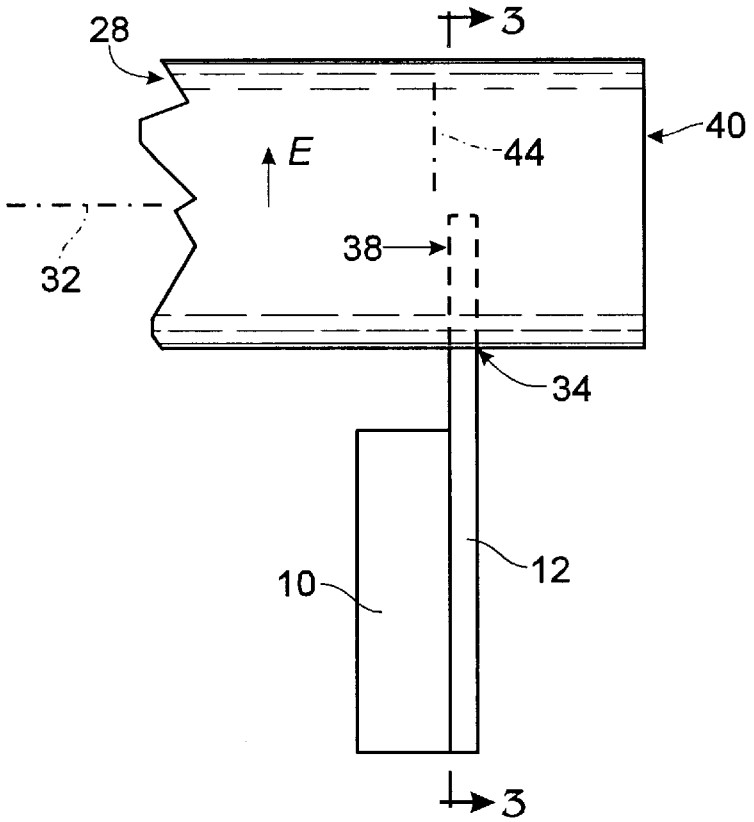
FIG. 1 is a side view of a circuit board interfaced with a microwave waveguide using a transition made according to the invention.
Figure 3:
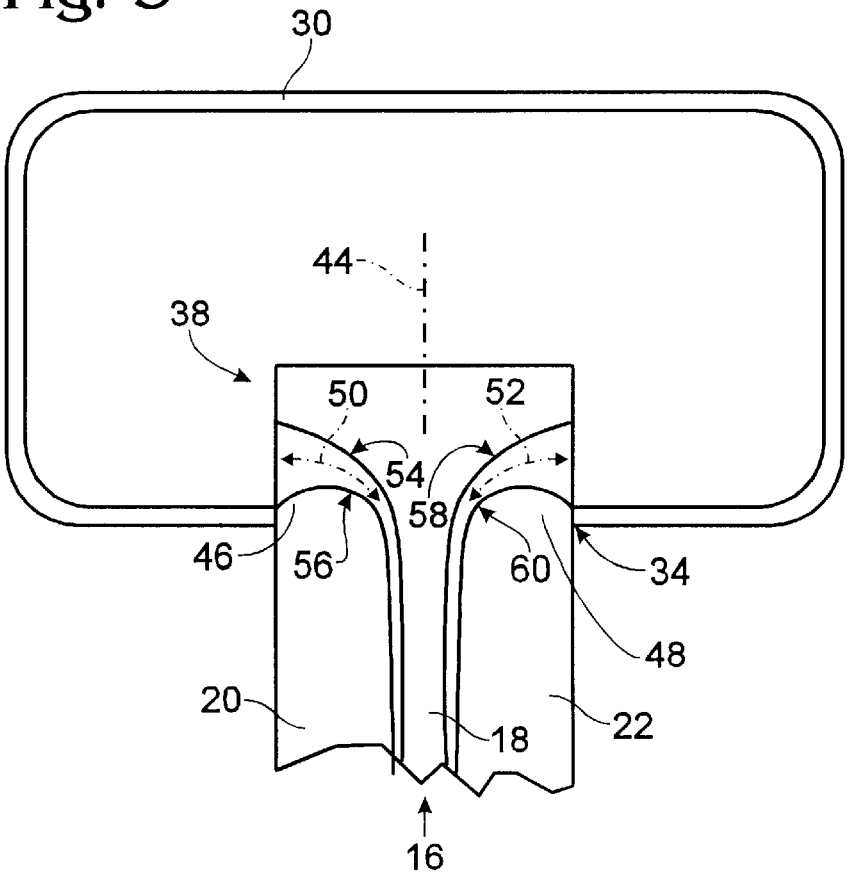
FIG. 3 is a section along lines 3—3 of FIG. 1.
Figure 2:
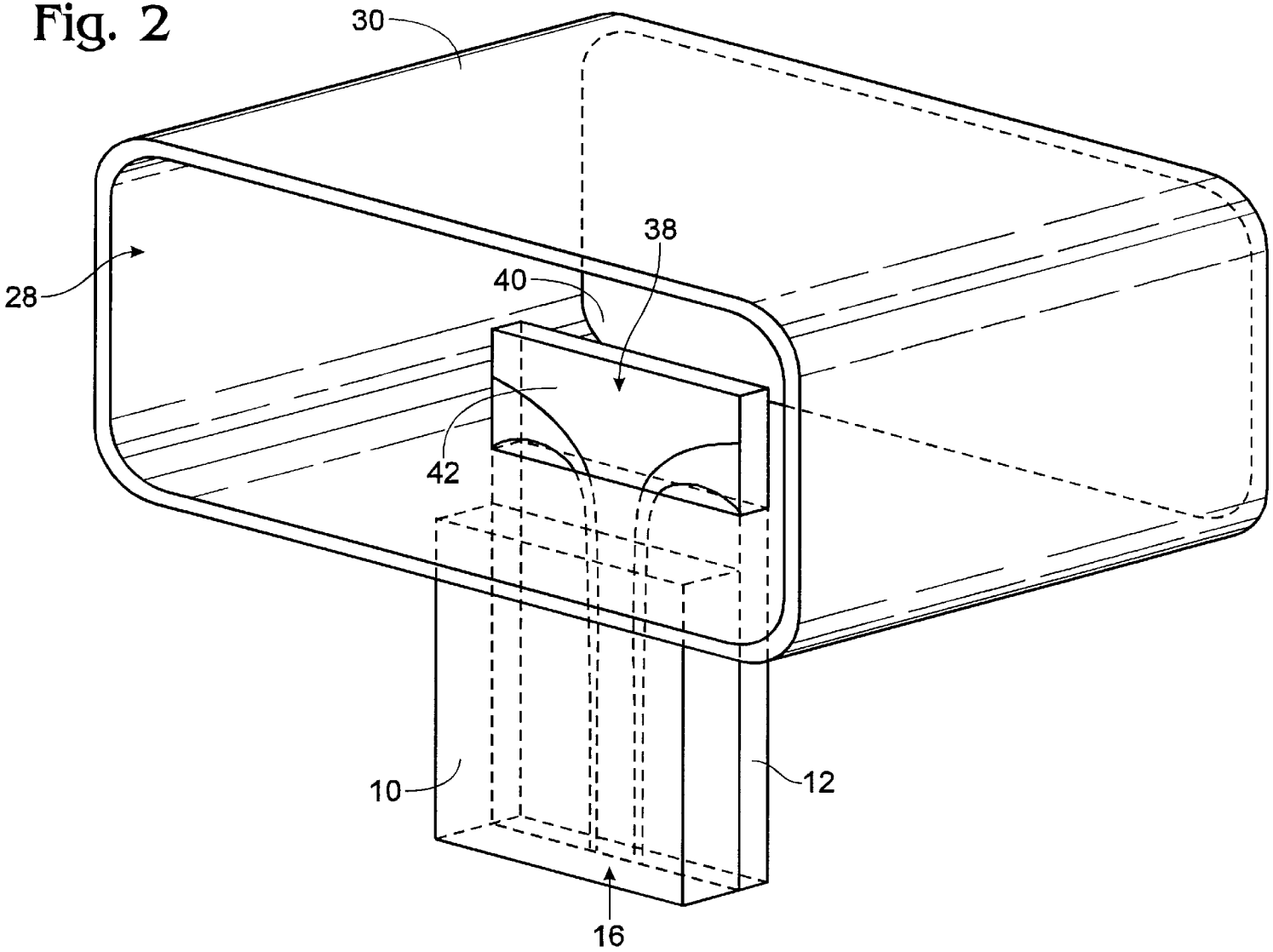
FIG. 2 is a perspective view of the circuit board interfaced with the microwave waveguide using the transition shown in FIG. 1.

As has been mentioned, the invention provides a transition for interfacing a circuit board transmission line with a hollow three dimensional microwave waveguide. The invention is now described in more detail with reference to FIGS. 1–3.

A microwave circuit 10 is formed on an insulating or dielectric circuit board 12. The board typically features a circuit transmission line in the form of a coplanar waveguide 16 disposed on the same side of board 12 as circuit 10. The transmission line is made of a center conductor 18 (also known as first transmission line conductor) and two side conductors 20, 22 (respectively also known as second and third transmission line conductors). The side conductors flank the center conductor to minimize signal loss. While it is highly preferred for the transmission line to have these conductors, it is not necessary. Indeed, aspects of the transition of the invention can be practiced with a transmission line made of two conductors, which need not even be planar.

Additionally, the present description applies to all three dimensional microwave waveguides, whether they have a hollow or dielectric interior, and an opening (usually shaped as a slot) that allows insertion of the transition. The configuration of such waveguides defines the direction of electric field propagation within them as parallel to a first direction longitudinal to the waveguide.

The most common type of a three dimensional waveguide is microwave guide 28 made by a main exterior shell or conductor 30. Main conductor 30 is shaped such that it defines a hollow interior, a direction of electric field propagation 32 along the longitudinal axis of the waveguide, and a slot 34.

In general, a transition 38 of the invention is structure connected directly to the end of transmission line 16. The transition extends into the interior of waveguide 28 through a slot 34. This way the transition interfaces the end of transmission line 16 with waveguide 28. As will be understood from the description, the transition of the invention is preferably formed on the circuit board integrally to transmission line 16, and as an extension of it.

It is preferred that waveguide 28 is terminated by a reflecting surface 40, also known as a backshort, that is oriented perpendicular to direction 32. Backshort 40 is preferably at a distance of one quarter wavelength from transition 38. The surface causes constructive interference of the wave at the transition, thus enhancing its effectiveness and bandwidth.

Transition 38 is now described in detail. The transition includes a conducting patch 42 that is connected directly to the end of center conductor 18, or is formed integrally with it. Patch 42 extends through opening 34 into the interior of waveguide 28. The portion of the patch that is located within the interior of the waveguide extends along a second direction 44, that is also known as the length dimension for the patch. Direction 44 is transverse to first direction 32 which, and preferably is substantially perpendicular to it.

Patch 42 has a width that increases, preferably continuously, along at least a portion of its length, with increasing distance from the end of the center conductor. Preferably the patch defines edges that are curved over at least a portion of their length. In its preferred embodiment, the patch is disposed in a plane transverse to direction 32, as shown.

The patch length must be large enough to couple the field in the waveguide well, but not so large as to obstruct the wave that has been reflected from backshort 40. A preferred dimension for the length is thus found to be about ⅓ of the height of the waveguide.

The optimum patch width is also a tradeoff between two parameters. First, the patch should be as wide as possible, to maximize the transition bandwidth. In addition, the total perimeter of slot 34 must be less than one wavelength, to avoid creating extraneous resonant modes. A preferred width for the patch is thus about ⅔ of the width of the waveguide. These dimensions yield a satisfactory bandwidth of 25%, while they confine the resonant modes to the high end of the waveguide band.

It is also preferred that the transition include a second transition conductor 46, and also a third transition conductor 48 that are attached respectively to side conductors 20 and 22 of transition line 16. In their preferred embodiment, the second and third transition conductors are formed as extensions of the side conductors. Further, the second and third transition conductors are preferably electrically connected to main conductor 30, to prevent the excitation of higher order modes. Transition conductors 46, 48 are preferably planar, and in the same plane as the patch.

Transition conductors 46, 48 flank patch 42 so as to form electric field guides 50, 52 in the gaps between the respective pairs of their edges 54, 56 and 58, 60. The edges are smooth to provide for smooth impedance transformation, although stepped gap widths would also be functional. The initial gap width matches that of coplanar waveguide 16. The gap width increases gradually as the gaps extend through slot 34 into waveguide 28 to provide impedance transformation. This is accomplished by having the second and third transition conductors extend into waveguide 28, at least partially.

The pairs of edges are curved over at least a portion of their length, and the guides extend away from each other, each making a total direction change of 90°. This reorients the electric field vector for optimum alignment with the propagation mode of waveguide 28.

As will be appreciated from this description, the invention provides many advantages over the prior art. The transition can be printed directly on the circuit board at a minimum additional manufacturing cost. The preferred embodiment provides a direct transition between coplanar waveguide and waveguide. The resulting transmission bandwidth is much higher than most communications systems require. Accordingly, receiver noise can be minimized by a low noise amplifier placed directly at the input of the system. Likewise, a power amplifier can be placed at the output to maximize power efficiency.

In the above description numerous details have been set forth in order to provide a more thorough understanding of the present invention. It will be obvious, however, to one skilled in the art that the present invention may be practiced without these specific details. In other instances, well known features have not been described in detail in order to not obscure unnecessarily the present invention.

The invention claimed is:

1. A transition for interfacing a three dimensional microwave waveguide with an end of a circuit transmission line, the waveguide being shaped such that it defines a substantially hollow interior with an opening, the waveguide further defining a direction of electric field propagation that is parallel to a first direction, the transmission line being disposed outside the waveguide and comprising at least first and second conductors, the transition comprising:

at least one guide coupled to the end of the transmission line, the guide including a first pair of continuous noncontacting conducting edges defining a gap, the gap extending through the opening at least partially in the interior of the waveguide, at least one of the edges being curved over at least a portion of its length, the portion of the guide located within the interior of the waveguide being disposed in a plane that is transverse to the first direction.

2. The transition of claim 1, wherein the three dimensional microwave waveguide includes a main external waveguide conductor, and wherein one of the conducting edges is electrically connected to the main external waveguide conductor.

3. The transition of claim 1, wherein at least a portion of each of the edges of the first pair is located within the interior of the waveguide.

4. The transition of claim 3, wherein the three dimensional microwave waveguide further defines the orientation of an electric field propagating in the waveguide to be parallel to a second direction perpendicular to a first direction, and wherein the end of the guide not coupled to the transmission line defines the orientation of an electric field propagating in it to be parallel to the second direction.

5. The transition of claim 1, wherein the guide is a coplanar waveguide shaped such that it further defines a second pair of edges coplanar with first pair of edges, the second pair of edges defining a second gap extending through the opening at least partially in the interior of the waveguide.

6. The transition of claim 5, wherein at least a portion of each of the edges of the first and second pairs is located within the interior of the waveguide.

7. The transition of claim 6, wherein the gaps extend away from each other in the waveguide.

* * * * *